US006659928B2

(12) United States Patent
Baumeister et al.

(10) Patent No.: US 6,659,928 B2
(45) Date of Patent: Dec. 9, 2003

(54) DEVICE FOR REMOVING FLAT ARTICLES

(75) Inventors: Bruno Baumeister, Heimbach (DE); Walter Baur, Gruendau (DE)

(73) Assignee: Rovema Verpackungsmaschinen GmbH, Fernwald (DE)

( * ) Notice: Subject to any disclaimer, the term of this patent is extended or adjusted under 35 U.S.C. 154(b) by 0 days.

(21) Appl. No.: 10/043,571

(22) Filed: Jan. 10, 2002

(65) Prior Publication Data

US 2002/0091052 A1 Jul. 11, 2002

(30) Foreign Application Priority Data

Jan. 11, 2001 (DE) ..... 101 00 968

(51) Int. Cl.[7] ..... B31B 1/80

(52) U.S. Cl. ..... 493/315; 493/317; 493/318; 53/381.1; 53/564; 414/737

(58) Field of Search ..... 493/315, 317, 493/318; 414/736, 737; 53/381.1, 566, 564

(56) References Cited

U.S. PATENT DOCUMENTS

| | | | | |
|---|---|---|---|---|
| 4,050,574 A | * | 9/1977 | Chenevard et al. | 198/458 |
| 4,197,790 A | | 4/1980 | Dietrich et al. | |
| 4,530,686 A | * | 7/1985 | Everson et al. | 493/315 |
| 4,537,587 A | * | 8/1985 | Langen | 493/315 |
| 4,871,348 A | | 10/1989 | Konaka | |
| 4,881,934 A | * | 11/1989 | Harston et al. | 493/315 |
| 5,054,761 A | * | 10/1991 | Dietrich et al. | 271/95 |
| 5,061,231 A | | 10/1991 | Dietrich et al. | |
| 5,078,669 A | | 1/1992 | Dietrich et al. | |
| 5,411,464 A | | 5/1995 | Calvert et al. | |
| 5,562,581 A | | 10/1996 | Roberto et al. | |
| 5,573,490 A | * | 11/1996 | Steinbrenner et al. | 493/315 |
| 5,662,577 A | * | 9/1997 | Reuteler | 493/315 |
| 5,715,657 A | * | 2/1998 | Mondani et al. | 53/457 |
| 5,775,062 A | * | 7/1998 | Ghini et al. | 53/461 |
| 5,782,734 A | | 7/1998 | Reuteler | |
| 5,910,078 A | | 6/1999 | Guttinger et al. | |

FOREIGN PATENT DOCUMENTS

| | | |
|---|---|---|
| DE | 40 29 520 C2 | 3/1992 |
| GB | 1 152 321 | 5/1969 |

OTHER PUBLICATIONS

U.S. Ser. No. 10/081 140, Applicant: Thomas Wyss, et al., filed Feb. 22, 2002, including specification, claims and 1 sheet of drawings.

* cited by examiner

*Primary Examiner*—Rinaldi I. Rada
*Assistant Examiner*—Thanh Truong
(74) *Attorney, Agent, or Firm*—Flynn, Thiel, Boutell & Tanis, P.C.

(57) ABSTRACT

A device for removing flat articles, in particular blanks of collapsed boxes from a delivery station and for transferring them to a receiving station which has a transport device thereat. Plural suction arms each with suction devices thereon are provided, which suction arms move through a self-contained cycloidal path. The cycloidal path has several tips and curved segments lying therebetween. The delivery station and the receiving station are each arranged at a tip of the cycloidal path. A rotor is provided for moving the suction arms. A sun and planet gear arrangement is provided on the rotor, which sun and planet gear delineate the cycloidal path. The suction arms are aligned parallel to one another and preferably to the transport direction of the transport device in order to achieve in this manner a technically simple and reliable device.

13 Claims, 2 Drawing Sheets

DEVICE FOR REMOVING FLAT ARTICLES

FIELD OF THE INVENTION

The invention relates to a device for removing flat articles, in particular blanks of collapsed boxes from a delivery station and for transferring these to a receiving station which has a transport device thereat to further transport the articles and to the provision of plural suction arms on a rotor which move through a closed cycloidal path, each having at least one suction device. The cycloidal path has plural tips and curved segments lying therebetween. The delivery station and the receiving station are each arranged at one tip of the cycloidal path.

BACKGROUND OF THE INVENTION

A device of this type is known from the DE 40 29 520. It is used to remove packaging blanks one by one from a magazine and to insert the blanks into compartments on a conveyor belt. The blanks are, during this insertion, pressed by means of a cam controlled mechanism and through a radial movement of the suction arms away from the rotor into the compartments and are thereat reshaped.

The known device has the disadvantage that the control mechanism is technically relatively expensive.

SUMMARY OF THE INVENTION

The basic purpose of the invention is therefore to provide a device of the above-described type, however, without a control mechanism. More specifically, a device is provided for removing flat articles, in particular blanks of collapsed boxes from a delivery station and for transferring them to a receiving station which has a transport device thereat. Plural suction arms each with suction devices thereon are provided, which suction arms move through a self-contained cycloidal path. The cycloidal path has several tips and curved segments lying therebetween. The delivery station and the receiving station are each arranged at a tip of the cycloidal path. A rotor is provided for moving the suction arms.

A sun and planet gear is provided on the rotor, which sun and planet gear delineates the cycloidal path, and the suction devices are aligned parallel to one another and preferably to the transport direction of the transport device.

The device of the invention has the advantage that it functions technically in a simple manner and without a control mechanism. The sun and planet gear is a common gear arrangement and actually produces the cycloidal path. The suction devices are aligned parallel to one another and remain always in this direction during their rotation. Thus, their connection to the sun and planet gear arrangement is also realizable in a simple manner. The suction devices are guided by the cycloidal path to an article, are then moved with the article to the delivery station, and are finally again placed on a following article.

An optimum time use of the device is achieved when three or four suction arms and pairs of suction fingers are provided on each suction arm. When an article is gripped by a pair of suction arms, then its removal and its forward movement are safer than if it were supposed to be moved merely by one single suction arm. The same purpose is also served by several suction devices on one suction arm.

When the rotor is continuously driven, then a particularly high article transfer rate is achieved since a standstill of the rotor is avoided. The movement of the rotor can thereby be slowed down by means of a servo technique at the tips of the cycloidal path, which tips are relevant for handling of the articles, in order to in this manner make the handling yet more reliable.

Flat collapsed-box blanks can be taken out of a magazine in order to erect these then along the cycloidal path on a guideway. The blanks are for this purpose moved with a prefolded edge along the guideway. The guideway is adapted to the cycloidal path in such a manner that when the blanks are moved along the cycloidal path, and the spacing between the guideway and the blank is reduced, the blank will be compressed in this manner to thereby erect the collapsed box. The erected box is subsequently delivered to the transport device.

BRIEF DESCRIPTION OF THE DRAWINGS

The invention will be described in greater detail hereinafter in connection with one exemplary embodiment and the drawings, in which.

DETAILED DESCRIPTION

Figure 1:
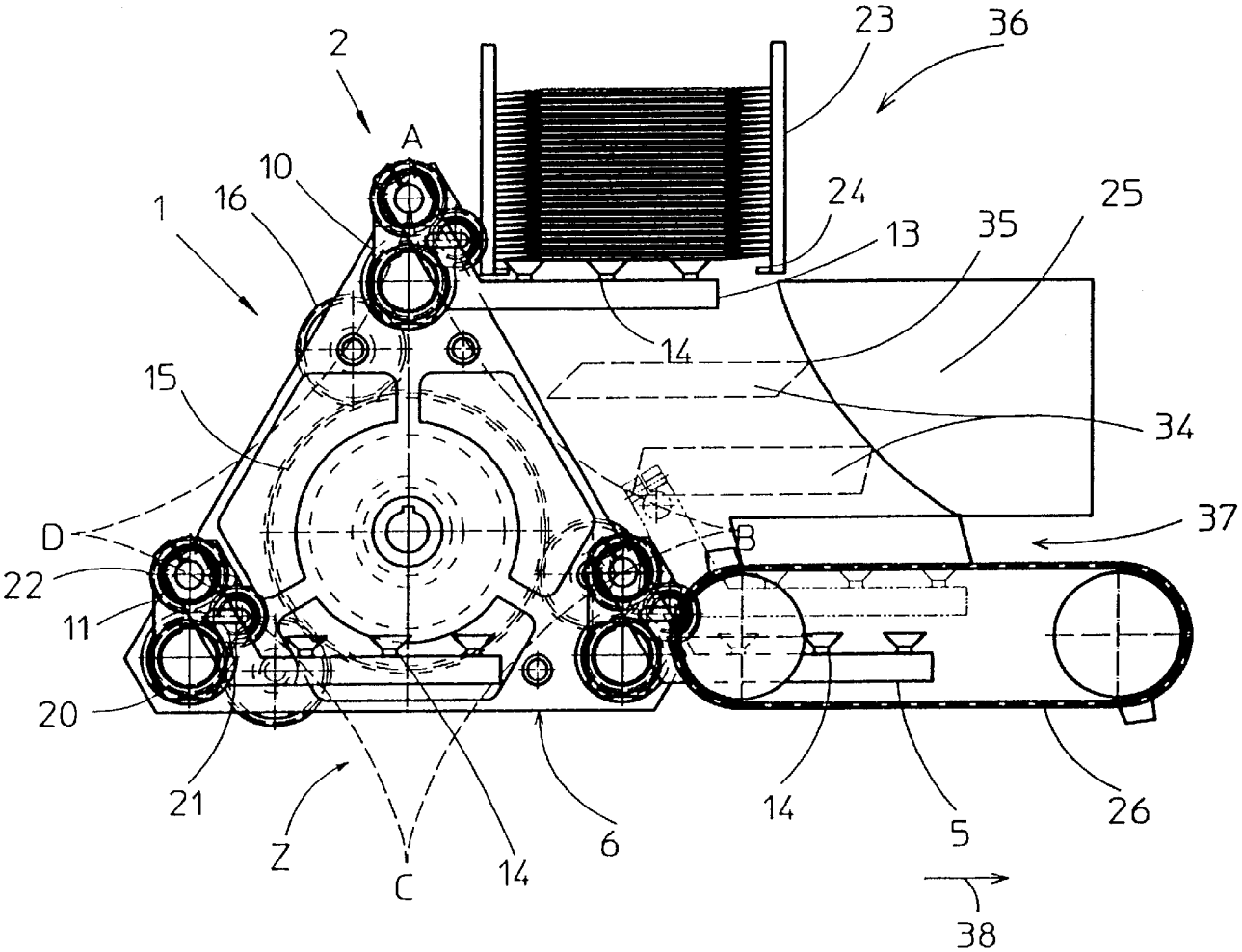
FIG. 1 is a side view of a planetary gearing on a rotor, whereby three suction arms are each connected to one planet in order to move along a cycloidal path so that a blank for a collapsed box is taken out of a magazine, is erected at a guideway, and is presented at a delivery station to a transport device.
Figure 2:
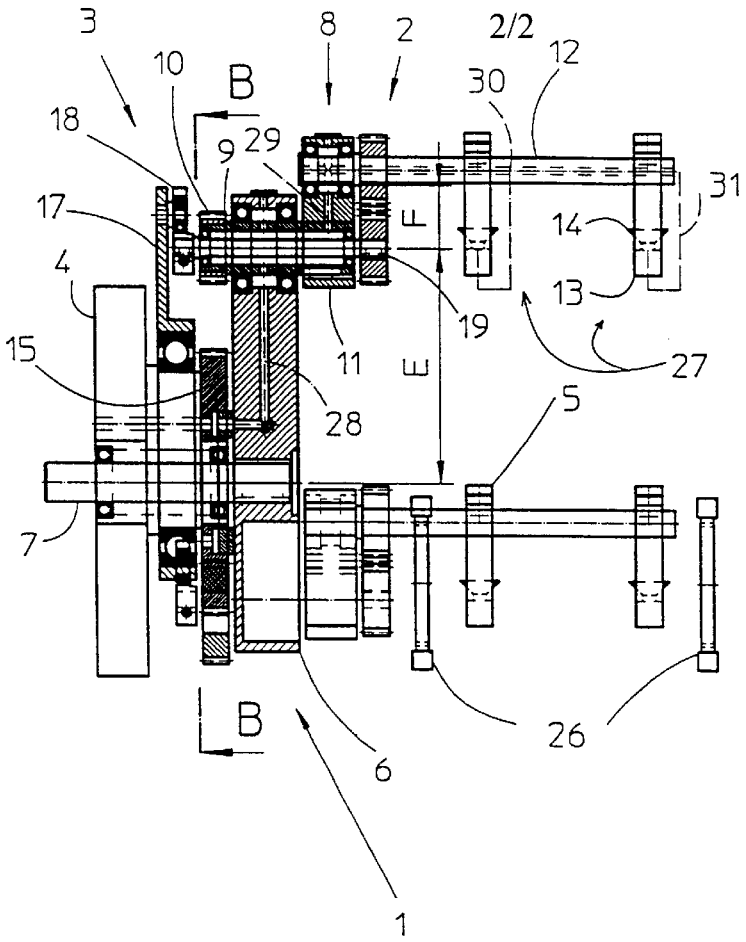
FIG. 2 is a cross-sectional illustration of the subject matter of FIG. 1.
Figure 3:
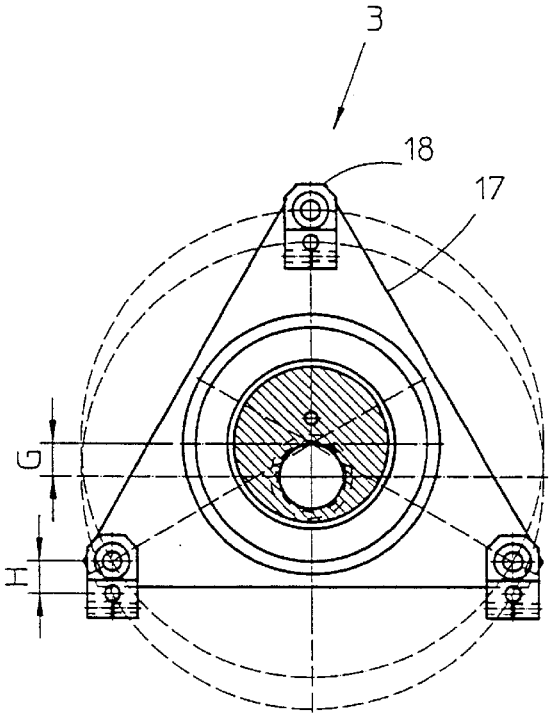
FIG. 3 is a cross section taken along the line B—B of FIG. 2.

The device houses a sun and planet gear arrangement 1, which describes a four-arc cycloidal path Z, and further, superposed gear steps 2, 3, which cause a total translation of 1:1 from the frame 4 to the suction arms 5 so that these delineate on the one hand a cycloidal path Z, however, at the same time remain always parallel to a straight line in the frame 4.

The sun and planet gear arrangement 1 consists of a rotor 6 which is fixedly connected to a drive shaft 7 supported on the frame 4. Three planets 8 are provided on the rotor 6, which planets consist of a hollow shaft 9, a spur gear 10 and a crank 11. The spur gear 10 and the crank 11 are fixedly connected to the hollow shaft 9. Shafts 12 are supported in the planets 8. Suction arms 13 with suction devices 14 are provided on the shafts 12.

A translation from the spur gear 9 to the frame-fixed spur gear 15 with i=4 is used for the creation of the four-arc cycloids, an intermediate gear 16 being supported on the rotor 6. The radius F of the planet has a relationship of approximately 1:3 with respect to the radius E of the rotor.

The gear steps 2 and 3 are superposed over the sun and planet gear 1 in order to achieve the parallelism of the suction device 14 and to the frame 4. The gear step 3 consists of a rotor 17, which is supported eccentrically with respect to the drive shaft 7 in the frame 4, a shaft 19, which is supported coaxially in the hollow shaft 9, and a crank 18, which is fixedly connected to the shaft 19. In order to achieve a translation of 1:1 from the frame 4 to the shaft 19, the eccentricity G must correspond with the crank radius H. The function thus corresponds to "half" of a Schmidt coupling. The gear step 2 consists of a spur gear 20, which is fixedly connected to the shaft 19, a further spur gear 22, which is fixedly connected to the shaft 12, and an intermediate gear 21, which is supported on the crank 11. The number of teeth of the spur gears 20 and 22 must hereby be identical.

When the suction arm 13, which includes a pair of suction fingers 27 on which is provided the suction devices 14, moves into the area of the tip A of the cycloidal path Z, a blank 34 is sucked from the magazine 23, and when the suction arm 13 leaves the tip A, this blank 34 is held by the suction devices 14 and is pulled out of the magazine 23 past the holding noses 24. When moving through the arc from tip A to tip B, the edge 35 of the blanks 34 remote from the sun and planet gear 1, is guided along a guideway 25 so that the flat blank 34 is erected into a sleeve. Prior to the suction arm 5 reaching tip B, the blank 34 is transferred to a moving transport device 26. The vacuum of the individual suction arms 5 are controlled mechanically by a circular-arc segment inserted into the spur gear 15. The air is sucked off through suction passageways 28, 29, 30 and a line 31 from the suction devices 14 so that the blank 34 will be adhered to the suction devices 14 by the suction force.

This system is particularly advantageous during the suction and erection since the blank 34 can at any time be held both parallel to the magazine 23 and also to the transport device 26 so that wider blanks 34 can also be easily processed. In addition it is advantageous that during the removal from the magazine 23 a movement in direction of the magazine 23 takes place almost exclusively, whereas the blank 34 has during the transfer to the transport device 26 already an inertial movement component in transport direction.

A further advantage is that any desired number of planets 8 with suction arms 13 can be fastened on the rotor 6. Thus it is, for example, possible when the number of pairs of suction arms 27 is increased from three to four to achieve a 33 percent increase in performance, whereas the driving speed and thus the suction, erection and transfer time remains the same as in the case of three pairs of suction arms 27.

List of Reference Numerals

A,B,C,D Tips
E,F radius
G eccentricity
H crank radius
Z cycloidal path
1 sun and planet gear
2,3 gear step
4 frame
5 suction arm
6 rotor
7 drive shaft
8 planet
9 hollow shaft
10 spur gear
11 crank
12 shaft
13 suction arm
14 suction device
15 spur gear
16 intermediate gear
17 rotor
18 crank
19 shaft
20 spur gear
21 intermediate gear
22 spur gear
23 magazine
24 holding noses
25 guideway
26 transport device
27 pair of suction fingers
28,29,30 suction passageway
31 line
34 blank
35 edge
36 delivery station
37 receiving station
38 transport device

What is claimed is:

1. A device for removing flat blanks of collapsed boxes from a delivery station, and for transferring the boxes to a receiving station which includes a transport device, comprising plural suction arms with suction devices supported thereon, the suction arms being rotatably supported for movement on a closed cycloidal path, wherein the cycloidal path is defined by plural tips separated by curved segments lying therebetween, wherein the delivery station and the receiving station are each arranged at a respective tip of the cycloidal path, and comprising a rotor for effecting movement of the suction arms, wherein a sun and a planet gear are provided on the rotor, the sun and planet gear delineating the cycloidal path, and wherein the suction arms are aligned parallel to one another and to a transport direction of the transport device.

2. The device according to claim 1, wherein at least three of the suction arms are provided on the device.

3. The device according to claim 1, wherein at least three pairs of the suction arms are provided on the device.

4. The device according to claim 1, wherein the rotor is continuously driven.

5. The device according to claim 1, wherein a magazine for storing the flat blanks is provided at the delivery station.

6. The device according to claim 1, wherein a guideway is provided along the cycloidal path between the delivery station and the receiving station, the guideway being configured to engage one edge of each blank in order to deform and erect the blank of a collapsed box.

7. A transfer device for removing flat blanks of collapsed boxes from a delivery station and transferring the blanks to a receiving station that includes a transport device, comprising:

a sun and planet gear arrangement; and suction arms supported by the planet gear arrangement at spaced locations about a circumference of the gear arrangement and aligned parallel to each other, said suction arms including suction devices;

wherein said sun and planet gear arrangement move the suction arms about a closed cycloidal path, the cycloidal path being defined by plural tips separated by curved segments lying therebetween, and wherein the delivery station and the receiving station are each arranged at a different one of the tips of the cycloidal path.

8. The transfer device of claim 7, wherein the suction arms are aligned parallel to each other during the movement about the closed cycloidal path.

9. The transfer device of claim 7, wherein the suction arms comprise a pair of suction arms at the spaced locations about a circumference of the gear arrangement.

10. The transfer device of claim 7, the sun and planet gear arrangement comprising a frame, a drive shaft supported on the frame, a rotor fixedly connected to the drive shaft and planets supported on the rotor.

11. The transfer device of claim 10, the sun and planet gear arrangement including a support shaft supporting the suction arms, one end of each of the support shafts being secured to a corresponding one of said planets.

12. The transfer device of claim 11, including gear steps superposed over the sun and planet gear arrangement to maintain the suction arms parallel to each other.

13. The transfer device of claim 7, wherein the lengths of the support arms define planes parallel to a plane defined by the transport direction of the transport device.

* * * * *